US005356139A

United States Patent [19]

Parsons

[11] Patent Number: 5,356,139

[45] Date of Patent: Oct. 18, 1994

[54] EXPANDABLE BATON WITH SECTIONS MADE OF DISSIMILAR MATERIALS

[75] Inventor: Kevin L. Parsons, Appleton, Wis.

[73] Assignee: Armament Systems and Procedures, Inc., Appleton, Wis.

[21] Appl. No.: 2,282

[22] Filed: Jan. 8, 1993

[51] Int. Cl.[5] ..... F41B 15/02

[52] U.S. Cl. ..... 273/84 R

[58] Field of Search ..... 273/84 R, 84 ES, 32 F, 273/80 D, 68, 69; 84/477 B; 135/75; 343/901; D21/100

[56] References Cited

U.S. PATENT DOCUMENTS 4,687,131 8/1987 von Braunhut ..... 273/84 R X
4,752,072 6/1988 Parsons ..... 273/84 R
5,160,140 11/1992 Starrett ..... 273/84 R

*Primary Examiner*—V. Millin
*Assistant Examiner*—William M. Pierce
*Attorney, Agent, or Firm*—Robert C. Curfiss

[57] ABSTRACT

An expandable baton includes a plurality of sections adapted to be stowed in a nested, collapsed position. The sections may be opened by swinging the baton in a whipping action into a locked extended position. Each of these sections may be made of similar or dissimilar materials, with the tip section having at least a portion being made of a relatively high mass material to preserve strike force when used in a whipping motion and the largest, handle section being made of a lightweight material to reduce weight of the overall baton. Intermediate sections may be included and may be made of either the lightweight material or the heavy mass material, as desired, taking into consideration force requirements in combination with overall balance and weight objectives.

14 Claims, 2 Drawing Sheets

EXPANDABLE BATON WITH SECTIONS MADE OF DISSIMILAR MATERIALS

BACKGROUND OF INVENTION

1. Field of Invention

The subject invention is generally related to nightsticks, batons and intermediate impact weapons and is specifically directed to an expandable baton for use by law enforcement personnel.

2. Description of the Prior Art

Nightsticks and batons are well known and have gained widespread acceptance as intermediate force weapons for use by law enforcement personnel. One of the best known of these weapons is the ASP Expandable Baton manufactured by Armament Systems and Procedures, the assignee of the subject application. Typically, the ASP Baton includes three telescoping sections, the outer, largest section defining a handle adapted for receiving and nesting the remaining sections when the baton is in a collapsed position. In this position, the baton is approximately 8 to 10 inches long and can be carried by law enforcement personnel in a suitable sheath on the belt of the uniform. The baton is adapted to be drawn quickly from the sheath and opened in a swinging action for whipping the nested sections out to an extended position and locking them in position for use as an intermediate force weapon.

Over the years, it has been determined that the expandable batons required for use by law enforcement personnel must be of sufficient strength and durability to eliminate the sections from separating and "flying apart" when the baton is whipped open, particularly after repeated uses. In addition, it has been found that the deadlock taper joint for frictionally locking the telescoping sections in the extended position must be of a sufficient hardness to assure good friction without extensive deformation, extending the life of the baton while at the same time eliminating the tendency of the baton to bend at the various joints. The ASP Baton is the first baton to address many of these issues and utilizes a hardened, heat treated steel alloy for assuring proper function and durability, as required by law enforcement personnel.

While the ASP Baton has greatly advanced the art relating to intermediate force weapons, its major drawback is the additional weight the baton adds to the standard issue equipment a law enforcement officer must carry on his person while on duty. Typically, law enforcement personnel carry portable two-way radios, firearms, ammunition, handcuffs, chemical irritants, and flashlights in addition to the intermediate force baton. When all of this equipment is positioned on the belt of the officer or elsewhere on his uniform, it adds substantially to the weight of the uniform and at times can become quite cumbersome. In an effort to reduce the weight requirements there has been a continuing move toward lighter weight equipment without sacrificing function. For example, many uniforms now have nylon issue belts rather than leather, the two-way radios have routinely become smaller and lighter in weight with the continuing development of solid state electronics. New battery sources and high intensity lamps have permitted flashlights to become smaller and lighter in weight. Side arms have continually gotten smaller and lighter in weight and are made of more exotic, lighter weight materials than their predecessors. Therefore, it is desirable to provide an intermediate force weapon which also contributes to the efforts to reduce the weight of equipment carried by law enforcement personnel.

While the ASP Baton continues to meet and exceed the functional requirements of law enforcement agencies, it would be desirable to reconfigure the baton to provide a reduction in weight without a loss of function. Several attempts have been undertaken to resolve this problem. For example, a functional baton can be made out of a lightweight material such as aluminum. However, the lightweight material, while properly locking and resisting bending has not proven successful, even with its dramatic weight advantage, because of the drop in striking force particularly when used in a swinging fashion.

When a law enforcement officer attempts to restrain an individual through a swinging action, the amount of force associated with the swing is attributable to the centrifugal force generated at the tip of the baton. Thus, the greater the weight of the baton and the longer the baton, the greater the force. Expandable batons, permitting a 9 inch stowed weapon to be expanded to approximately 26 inches, have greatly increased the length of the weapons usable by the law enforcement officer and have permitted a dramatic increase in the inertia provided by weapon use in a swinging fashion. In addition, the steel weight has also contributed greatly to the swinging force generated by the weapon. By substituting a lightweight material such as aluminum for the baton, the second factor of the equation has been reduced, greatly reducing the resulting impact force created by the swinging action.

Therefore, there remains a desirability to provide a lightweight, expandable, intermediate force baton for use by law enforcement personnel which maintains the strike force capability of prior art batons while at the same time greatly reducing the weight of the weapon.

SUMMARY OF THE INVENTION

The subject invention is directed to a lightweight expandable baton wherein the various sections of the baton are made of dissimilar materials, permitting the baton to be lighter in weight while at the same time maintaining the durability and strike force capability of the baton. The baton of the subject invention recognizes that the strike force is primarily created by the centrifugal force generated by the mass at the tip of the baton. Therefore, the handle section and intermediate sections can be made of a lightweight material without greatly altering the impact force of the baton as long as the outer mass of the baton is maintained.

The invention includes several alternative embodiments combining lightweight materials with high mass materials to create a lightweight intermediate force baton with good strike force capability. In the preferred embodiment of the invention, the handle section and any intermediate sections are made of a lightweight durable material such as aluminum. However, it will be readily recognized that other lightweight materials such as wound composites, carbon fibers and the like could also be used. The tip section of the baton is a hardened steel material which has the same mass and function as the tip section of prior art batons. By placing the heavy mass at the outer tip end of the baton, the strike force capability of the baton is maintained virtually unchanged from the heavier prior art batons.

In another embodiment, all three sections of the baton are constructed of light weight material, with a high density sleeve added to at least a portion of the tip section in order to increase its mass. Hardened steel inserts may also be included in the joint areas to increase joint durability.

Numerous other combinations of heavy and light materials may be used to optimize the design for specific applications. It is a feature of the baton that the area of impact, which is the tip end section, includes a hardened lock surface, increasing the durability of the baton, particularly after repeated use. While lightweight locks have been found to be acceptable, the increased strength of the hardened lock on the outer tip increases the life of the baton while taking advantage of the lightweight materials for the inner telescoping sections.

The typical intermediate force baton made in accordance with the subject invention weighs approximately 10 ounces. This contrasts with the typical all steel baton which weighs approximately 20 ounces. This significant weight advantage has an impact on the adaptability and acceptability of the baton by law enforcement personnel. By reducing the weight of the baton, coupled with the reduction in weight of the other equipment carried by the officer, the fatigue factor on the officer is reduced and, in addition, additional equipment can be carried without an overall increase in weight requirements.

The lightweight expandable baton of the subject invention provides an improved intermediate force baton combining the lightweight materials in the handle and center sections with a high mass tip section to gain a weight advantage while retaining the desirable impact and durability features of a heavier mass baton at the strike force area.

Therefore, it is an object and feature of the subject invention to provide a baton of lighter weight than an all steel baton without noticeable loss of strike force capability.

It is also an object and feature of the subject invention to provide a baton utilizing a high mass at the strike force area while utilizing a lightweight material in the handle and intermediate area.

It is a further object and feature of the subject invention to provide an expandable lightweight baton wherein the various sections of the baton are made of dissimilar materials having different specific weights and different hardnesses.

It is yet another object and feature of the subject invention to provide a lightweight baton which has the durability and functional characteristics of heavier, all steel expandable batons.

Other objects and features will be readily apparent from the accompanying drawings and description.

DETAILED DESCRIPTION OF THE DRAWINGS

Figure 1:
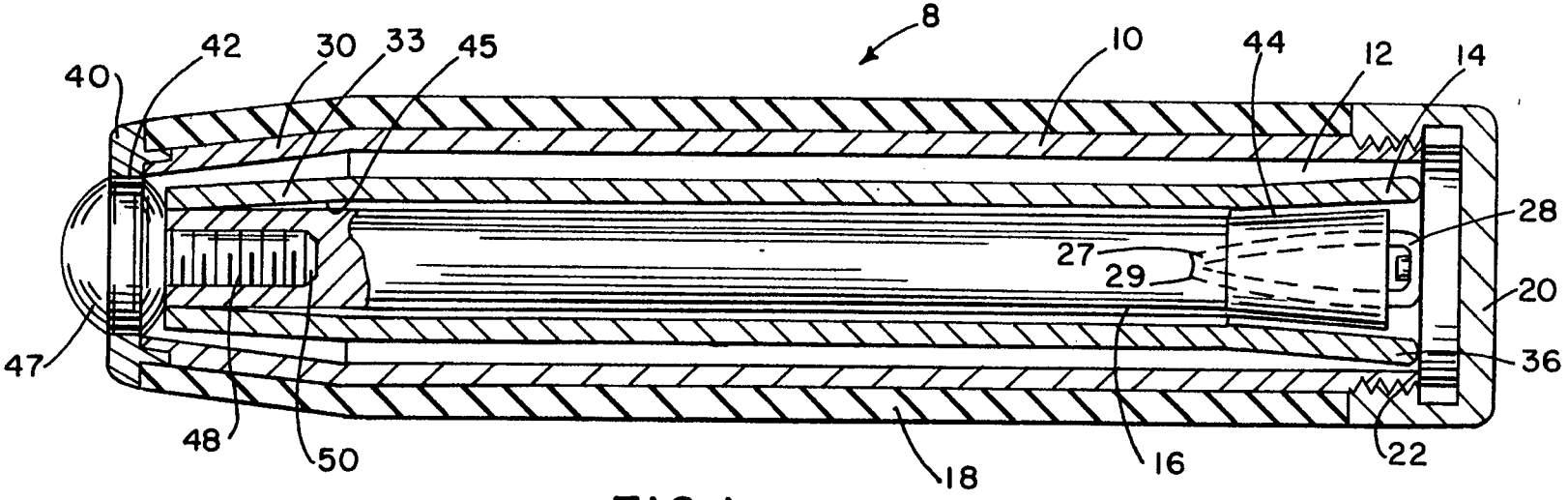
FIG. 1 is a longitudinal sectional view of an expanded baton made in accordance with the teachings of the subject invention and shown in the nested, collapsed position.

The baton 8 of the subject invention generally comprises an outer generally substantially cylindrical section 10 having an interior open cavity 12 adapted for receiving the remaining sections 14 and 16 of the baton for stowing them in nested fashion. In the preferred embodiment, a resilient sleeve or cover 18 is positioned over the outer section 10 for providing a resilient, non-slipping handle by which the baton may be grasped during use. Typically, the baton section 10 includes a closure cap 20 at one end thereof for closing the open end. In the preferred embodiment, the cap 20 is adapted to fit over the perimeter of the outer section 10, and is threadably received thereon, as at 22 for tightening the cap about and closing the open end. In assembly, the remaining nested sections 14 and 16 of the baton are placed in the cavity 12, after which the cap 20 is placed in position and tightened for retaining the sections therein. Also, in the preferred embodiment, a nesting lock system 24 is secured in the cap 20 and includes a dual leaf spring 28 or similar securing device having legs 27, 29 which are adapted to be received in the hollow end of the tip section 16. The spring legs extend into the interior of the section 16 for engaging the inner peripheral wall to secure the baton for securing the baton in the collapsed position shown in FIG. 1. The preferred embodiment of the retainer clip is shown and described in my issued U.S. Pat. No. 5,161,800, incorporated by reference herein.

In the preferred embodiment, the opposite open end 30 of the outer section is tapered to define a reduced opening 32. The next adjacent baton section 14 is likewise tapered at 33. The cylindrical portion of the section 14 and the tapered portion 33 easily pass through the opening 32 of the outer section 10. The opposite end of the section 14 is flared as at 36.

Figure 2:
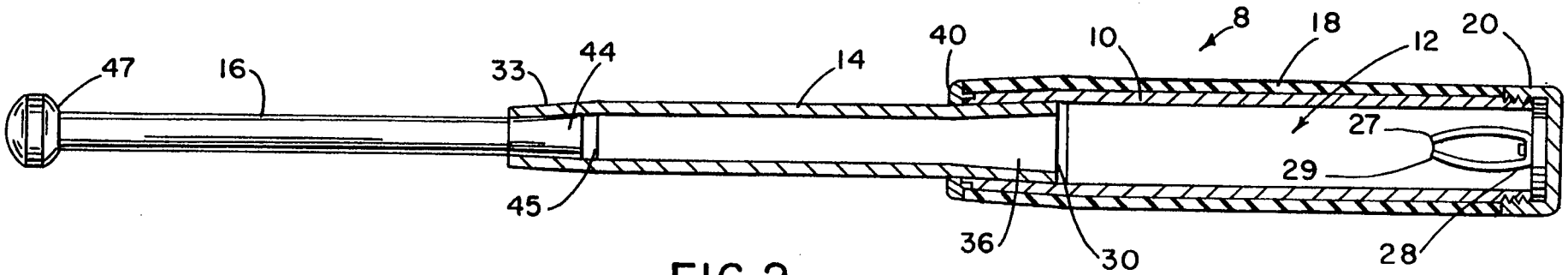
FIG. 2 is a longitudinal sectional view of a baton made in accordance with the teachings of the subject invention and shown in the extended, locked position.

In the preferred embodiment, and as disclosed in my issued U.S. Pat. No. 5,110,375 and incorporated herein by reference, the angle of taper at 30 and the angle of flare at 36 are set to define a deadlock taper when the section 14 is whipped to the extended position shown in FIG. 2, wherein the flare 36 engages the taper 30 to lock the baton in the extended position. An end cap 40 may be provided and secured to the outer end of baton section 10 and includes an opening 42 suitable for passing the tapered portion 33 and the cylindrical portion of section 14, but not the flare 36, to permit the baton to be extended to the locked position shown in FIG. 2.

In the preferred embodiment, an additional nested section 16 is housed in the hollow interior of section 14 and includes a flared end 44 which is adapted to engage the interior tapered wall 45 formed by the tapered end 33 of section 14. The taper 45 and flare 44 engage to define a taper lock, as previously described.

In the preferred embodiment, it is also desirable to provide an enlarged tip 47 which may be suitably secured to the outer end of the baton section 16. For example, the enlarged tip 47 may include an integral post or stud 48 having external threads and the interior wall of the section 16 may be internally threaded as at 50 for receiving and securing the threads 48 and securing the tip 47 in the baton section 16.

In the subject invention, the extended tip section 16 of the baton is made of a heavy, hardened steel alloy to preserve the strike force created when using this baton in a swinging fashion by providing sufficient mass at the outer end of the baton to take advantage of the centrifugal force generated during a swinging or whipping action. However, to reduce the weight of the baton, the handle section 10 is made of a lightweight material such as aluminum, wound fibers or the like. Also, depending on the weight requirements, the intermediate section 14 of the baton may be made of aluminum or other lightweight materials, as desired. Of course, where weight is not as critical a factor, the intermediate section may be made of hardened steel. Thus, the subject invention permits the baton to be of selective weights and masses by interchanging the material of the intermediate section while maintaining the handle as an aluminum or other lightweight material and the outer tip section 16 of steel or other heavyweight, durable, hardened material.

Figure 3:
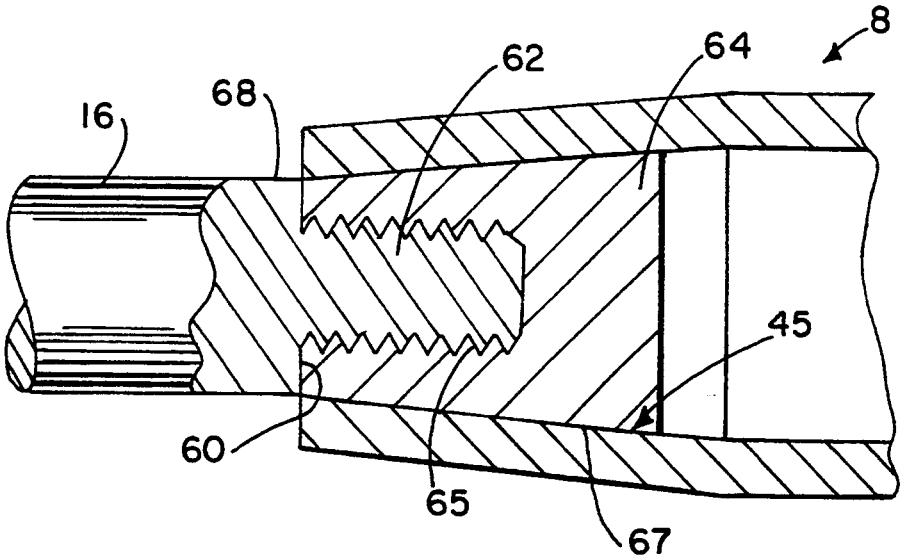
FIG. 3 is a fragmentary longitudinal sectional view, illustrating a modification of the tip section of the baton.
Figure 4:
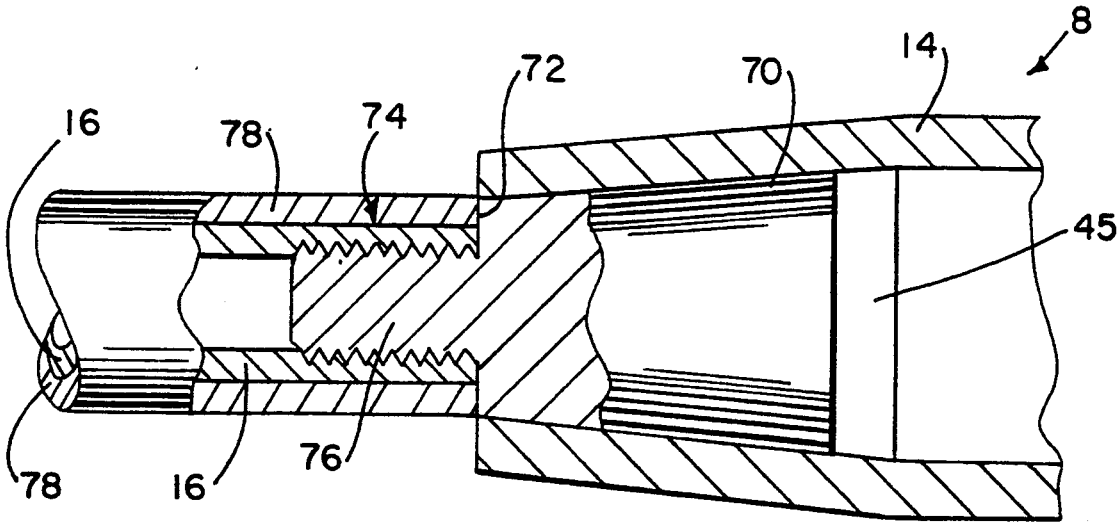
FIG. 4 is a fragmentary view similar to FIG. 3, illustrating an alternative, modified tip section of the baton.

Additional weight alterations and balance adjustments of the baton may be achieved by using the modifications shown in FIGS. 3 and 4. As shown in FIG. 3, the tip section 16 of the baton has an inner end 68 which is of a straight or cylindrical taper and terminates at a flat end wall 60. A threaded pin 62 extends axially outward from the wall 60. A tapered lock insert or adapter 64 is provided with an internally threaded bore 65 adapted to receive the pin 62 for securing the insert 64 to the tip section 16. The insert 64 may be made of a hardened material such as a hardened steel alloy or the like for increasing the strength of the taper lock defined by the insert flare 67 and the taper 45 of the adjoining sections. The lock insert 64 may be solid, as drawn, or may include a hollow cavity adapted for receiving and engaging the spring retainer 28 when in the nested position. When the insert is solid, the spring retainer 28 would be replaced with alternative nesting retainer means, such as a magnet or the like.

Of course, an insert similar to lock insert 64 can also be incorporated in the inner end 36 of the intermediate section 14, further increasing the durability of the lock provided between the flare 36 and the taper 30 between adjoining sections 10 and 14 when the baton is in the extended position. When the insert is so utilized, it is of a ring construction with a hollow core for accommodating the tip section 16 when in the nested position.

As shown in FIG. 4, an alternative lock insert 70 can be constructed to form a rim 72 that extends radially outwardly from the outer perimeter 74 of the tip section 16. As shown, the insert includes a threaded post 76 extending axially from the rim 72 and the tip section 16 is internally threaded for receiving the post. The tip section 16 may be made of a light weight material. A hardened cylindrical sleeve 78 may be placed over tip section 16 to provide the added mass and weight. The sleeve 78 is held in position between rim 72 of insert 70 and the enlarged outer tip 47, see FIGS. 1 and 2. Of course, the insert 70 either may be solid or may include a hollow cavity for receiving retainer 28, as desired.

Where desired, other locking systems could be substituted for the dead lock taper, while still incorporating the combination of light weight and heavy materials to meet weight and balance objectives. By way of example, a button detent lock system is shown and described in my U.S. Pat. No. 5,149,092, incorporated by reference herein.

The various features of the embodiments of the baton may be utilized in a variety of combinations to achieve the desired weight, balance and strength for any of a variety of applications, greatly increasing the versatility of the weapon. The subject invention provides a durable, lightweight baton, wherein the various sections of the baton may be made of lightweight materials or heavy mass materials, as desired in order to meet the strike force objectives combined with the weight and balance objectives for various uses.

The baton of the subject invention provides a flexible design wherein mass considerations, strike force capability and weight issues can be addressed and met by using the proper selected combination of materials for each of the various sections 10, 14 and 16 of the baton without sacrificing function and durability, while accommodating the desire to reduce the overall weight of the equipment carried by law enforcement personnel.

While specific embodiments and features of the invention have been disclosed herein, it will be readily understood that the invention encompasses all enhancements and modifications within the scope and spirit of the following claims.

What is claimed is:

1. A rigid expandable baton for use as an intermediate force weapon by law enforcement personnel, the baton of the type having a plurality of elongated, nesting, telescoping rigid baton sections, one of which is a handle adapted for receiving and housing any remaining sections when the baton is in a retracted, collapsed position, the remaining rigid sections being releasable outwardly from the handle and selectively self-locking in an extended position and slidably retractable into the collapsed position, the expandable baton further comprising:

a. the handle having a hollow interior and an open outer end through which any remaining rigid sections pass, said handle being constructed of a first material having a first specific weight and a first hardness;

b. one additional rigid baton section having an outer perimeter adapted for passing through the open outer end of the handle, said additional baton section having opposite ends, an outer and an inner end, the inner end always being contained in an adjacent receiving rigid baton section in both the expanded and nested positions, at least a portion of said additional rigid baton section being constructed of a second material having a second specific weight and a second hardness which is different from the first material;

c. an intermediate baton section constructed of the first material having a hollow interior and open inner and outer ends, and wherein said one additional baton section is of an outer perimeter adapted to pass through the open inner end of said intermediate baton section; and d. means for locking the baton in the extended position wherein the open outer end of said handle and said intermediate baton section each has a decreasing, tapered internal diameter and the inner end of the adjacent nesting baton section has an increasing, flared outer diameter such that the flared inner end of the nesting baton section engages the tapered outer end of the adjacent receiving baton section when the baton is in the expanded position.

2. The expandable baton of claim 1, wherein the specific weight and the hardness of the first material are lower than the specific weight and the hardness of the second material.

3. The expandable baton of claim 1, wherein said one additional baton section is constructed entirely of the second material.

4. The expandable baton of claim 3, wherein said first material is aluminum and said second material is hardened steel.

5. The expandable baton of claim 1, wherein the baton is adapted to be slidably transformed from the collapsed position to the expanded position by grasping the largest section and swinging the baton in a whipping action, and wherein the tapered outer end comprises means for frictionally engaging and thereby forming a deadlock with the flared inner end.

6. The expandable baton of claim 5, wherein a sharp axial blow to an exposed end of the baton when in its expanded position comprises the only means for releasing the deadlock formed by the tapered outer end and flared inner end.

7. The expandable baton of claim 1, the additional rigid baton section further including an enlarged tip adapted to be secured to the outer end of the additional rigid baton section, said tip being constructed of the second material.

8. The expandable baton of claim 7, the enlarged tip further having an external threaded perimeter and the outer end of the additional rigid baton section having an internal thread whereby the tip can be threadably secured to the outer end.

9. A rigid expandable baton for use as an intermediate force weapon by law enforcement personnel, the baton of the type having a plurality of elongated, nesting, telescoping rigid baton sections, one of which is a handle adapted for receiving and housing any remaining sections when the baton is in a retracted, collapsed position, the remaining rigid sections being releasable outwardly from the handle and selectively self-locking in an extended position and slidably retractable into the collapsed position, the expandable baton further comprising:

a. the handle having a hollow interior and an open outer end through which any remaining rigid sections pass, said handle being constructed of a first material having a first specific weight and a first hardness;

b. one additional rigid baton section having an outer perimeter adapted for passing through the open outer end of the handle, said additional baton section having opposite ends, an outer and an inner end, the inner end always being contained in an adjacent receiving rigid baton section in both the expanded and nested positions, at least a portion of said additional rigid baton section being constructed of a second material having a second specific weight and a second hardness which is different from the first material;

c. means for locking the baton in the extended position wherein the open outer end of said handle has a decreasing, tapered internal diameter and the inner end of the adjacent nesting baton section has an increasing, flared outer diameter such that the flared inner end of the nesting baton section engages the tapered outer end of the adjacent receiving baton section when the baton is in the expanded position;

d. an insert adapted to be inserted and secured to the inner end of the additional rigid baton section, said insert being constructed of the second material; and e. a sleeve enveloping the outer perimeter of the one additional section.

10. The expandable baton of claim 9, wherein said sleeve is constructed of the second material.

11. The expandable baton of claim 9, wherein said sleeve is adapted for enveloping said one additional section and is engaged by and held in position by said insert.

12. A rigid expandable baton for use as an intermediate force weapon by law enforcement personnel, the baton of the type having a plurality of elongated, telescoping rigid baton sections, nesting along a longitudinal axis, one of which is a handle adapted for receiving and housing any remaining sections when the baton is in a retracted, collapsed position, the remaining rigid sections being releasable outwardly from the handle and selectively self-locking in an extended position and slidably retractable into the collapsed position, the expandable baton further comprising:

a. the handle having a hollow interior and an open outer end through which any remaining rigid sections pass, said handle being constructed of a first material having a first specific weight and a first hardness;

b. one additional rigid baton section having an outer perimeter adapted for passing through the open outer end of the handle, said additional baton section having opposite ends, an outer and an inner end, the inner end always being contained in an adjacent receiving rigid baton section in both the expanded and nested positions, at least a portion of said additional rigid baton section being constructed of a second material having a second specific weight and a second hardness which is different from the first material;

c. means for locking the baton in the extended position wherein the open outer end of said handle has a decreasing, tapered internal diameter and the inner end of the adjacent nesting baton section has an increasing, flared outer diameter such that the flared inner end of the nesting baton section engages the tapered outer end of the adjacent receiving baton section when the baton is in the expanded position;

d. wherein the tapered outer end intersects the longitudinal axis of the baton at a first angle and the flared inner end intersects the longitudinal axis of the baton at a second angle, and wherein said first angle is larger than said second angle.

13. A rigid expandable baton for use as an intermediate force weapon by law enforcement personnel, the baton of the type having a plurality of elongated, nesting, telescoping rigid baton sections, one of which is a handle adapted for receiving and housing any remaining sections when the baton is in a retracted, collapsed position, the remaining rigid sections being releasable outwardly from the handle and selectively self-locking in an extended position and slidably retractable into the collapsed position, the expandable baton further comprising:

a. the handle having a hollow interior and an open outer end through which any remaining rigid sections pass, said handle being constructed of a first material having a first specific weight and a first hardness;

b. one additional rigid baton section having an outer perimeter adapted for passing through the open outer end of the handle, said additional baton section having opposite ends, an outer and an inner end, the inner end always being contained in an adjacent receiving rigid baton section in both the expanded and nested positions, at least a portion of said additional rigid baton section being constructed of a second material having a second specific weight and a second hardness which is different from the first material;

c. means for locking the baton in the extended position wherein the open outer end of said handle has a decreasing, tapered internal diameter and the inner end of the adjacent nesting baton section has an increasing, flared outer diameter such that the flared inner end of the nesting baton section engages the tapered outer end of the adjacent receiving baton section when the baton is in the expanded position; and d. the additional rigid baton section being constructed of the first material, said additional rigid baton section further comprising an insert adapted to be inserted and secured to the inner end of the additional rigid baton section, said insert being constructed of the second material.

14. The expandable baton of claim 13, the inner end further including an internal thread and the insert having a threaded external perimeter whereby the insert can be inserted and threadably secured to the inner end.

* * * * *